US009787038B2

(12) United States Patent
Zhang et al.

(10) Patent No.: US 9,787,038 B2
(45) Date of Patent: Oct. 10, 2017

(54) USB INTERFACE AND MOBILE TERMINAL

(71) Applicant: GUANGDONG OPPO MOBILE TELECOMMUNICATIONS CORP., LTD., Dongguan (CN)

(72) Inventors: Jialiang Zhang, Dongguan (CN); Yunxiang Liu, Dongguan (CN); Fengshuo Liu, Dongguan (CN); Feiwu Shuai, Dongguan (CN)

(73) Assignee: Guangdong Oppo Mobile Telecommunications Corp., Ltd., Dongguan (CN)

( * ) Notice: Subject to any disclaimer, the term of this patent is extended or adjusted under 35 U.S.C. 154(b) by 0 days.

(21) Appl. No.: 15/114,940

(22) PCT Filed: May 12, 2014

(86) PCT No.: PCT/CN2014/077272
§ 371 (c)(1),
(2) Date: Jul. 28, 2016

(87) PCT Pub. No.: WO2015/113340
PCT Pub. Date: Aug. 6, 2015

(65) Prior Publication Data

US 2016/0372876 A1 Dec. 22, 2016

(30) Foreign Application Priority Data

Jan. 28, 2014 (CN) ..... 2014 1 0043036

(51) Int. Cl.
*H01R 24/00* (2011.01)
*H01R 24/64* (2011.01)
(Continued)

(52) U.S. Cl.
CPC ..... *H01R 24/64* (2013.01); *H01R 24/62* (2013.01); *H01R 23/02* (2013.01);
(Continued)

(58) Field of Classification Search
CPC ..... H01R 23/02; H01R 24/60; H01R 23/7073
(Continued)

(56) References Cited

U.S. PATENT DOCUMENTS 8,102,657 B2 1/2012 Hiew et al.
8,480,436 B2 * 7/2013 Chang ..... H01R 12/724 439/660
(Continued)

FOREIGN PATENT DOCUMENTS

CN 2381388 Y 2/2005
CN 201256225 Y 6/2009
(Continued)

OTHER PUBLICATIONS

Translation of the International Search Report and Written Opinion corresponding to International Patent Application No. PCT/CN2014/077272, dated Oct. 27, 2014, 11 pages.
(Continued)

*Primary Examiner* — Tho D Ta
*Assistant Examiner* — Thang Nguyen
(74) *Attorney, Agent, or Firm* — Lathrop Gage LLP

(57) ABSTRACT

The present disclosure provides a USB interface and a mobile terminal. The USB interface includes a USB interface main body, an inserting tongue of a power line configured for coupling to an external power line via inserting portions and an inserting tongue of a ground line configured for coupling to an external ground line via inserting portions, in which a bottom of the inserting tongue of the power line and a bottom edge of the inserting tongue of the ground line are coupled to the USB interface main body; the inserting tongue of the power line has P inserting portions extending therefrom, where P is greater than or equal to 2; and the inserting tongue of the ground line has Q inserting portions extending therefrom, where Q is greater than or equal to 2.

19 Claims, 2 Drawing Sheets

(51) Int. Cl.

| | |
|---|---|
| ***H01R 24/62*** | (2011.01) |
| *H01R 24/60* | (2011.01) |
| *H01R 12/50* | (2011.01) |
| *H01R 107/00* | (2006.01) |

(52) U.S. Cl.
CPC ..... *H01R 23/7073* (2013.01); *H01R 24/60* (2013.01); *H01R 2107/00* (2013.01)

(58) Field of Classification Search
USPC ..... 439/660, 607.01, 607.4, 271
See application file for complete search history.

(56) References Cited

U.S. PATENT DOCUMENTS

| | | | | |
|---|---|---|---|---|
| 9,502,839 | B2 * | 11/2016 | Tsai | H01R 12/724 |
| 2009/0093136 | A1 | 4/2009 | Hiew et al. | |
| 2014/0287626 | A1 * | 9/2014 | Lin | H01R 24/78 439/607.56 |
| 2015/0200504 | A1 * | 7/2015 | Little | H01R 24/60 439/345 |

FOREIGN PATENT DOCUMENTS

| | | | | |
|---|---|---|---|---|
| CN | 201327930 Y | * | 10/2009 | H01R 13/40 |
| CN | 201327930 Y | | 10/2009 | |
| CN | 201752040 U | | 2/2011 | |
| CN | 202058908 U | * | 11/2011 | H01R 13/46 |
| CN | 202058908 U | | 11/2011 | |
| CN | 202772376 U | | 3/2013 | |
| CN | 202872017 U | | 4/2013 | |
| CN | 203553401 U | | 4/2014 | |

OTHER PUBLICATIONS

Translation of the International Preliminary Report on Patentability Chapter I corresponding to International Patent Application No. PCT/CN2014/077272, dated Aug. 2, 2016,10 pages.
Chinese Patent Application No. CN201410043036.8; First Office Action with English translation, dated Jun. 23, 2016, 8 pages.
Chinese Patent Application No. CN201410043036.8; First Search, dated Jun. 15, 2016, 1 page.
Chinese Patent Application No. CN201410043036.8; Second Office Action with English translation, dated Jan. 3, 2017, 7 pages.

* cited by examiner

USB INTERFACE AND MOBILE TERMINAL

CROSS REFERENCE

This application is based on and claims priority to Chinese Patent Application No. 201410043036.8, titled "USB interface and mobile terminal", filed on Jan. 28, 2014, the entire contents of which are incorporated herein by reference.

FIELD

The present disclosure relates to the mobile terminal field, and more particularly to a USB (Universal Series Bus) interface and a mobile terminal.

BACKGROUND

With the time goes on, the Internet and mobile communication networks provide a large number of function applications. A user cannot only use the mobile terminal to perform a conventional application, such as answering the phone or making a call, but can also use the mobile terminal to browse webpages, transmit pictures and play games, etc.

When being used to deal with things, the mobile terminal may largely consume electricity of the cell thereof because of an increased usage frequency thereof, which require frequent charging; with the accelerated pace of life, especially more and more urgent emergencies, the user wants the cell to be charged with the large current.

The MICRO USB interface is often used to charge the mobile terminal in the related art. Since the MICRO USB interface in the related art only includes an inserting tongue of a power line with one inserting portion, an inserting tongue of a ground line with one inserting portion, one power pin coupled to the inserting tongue of the power line and one ground pin coupled to the inserting tongue of the ground line, the charging may be performed through only one charging circuit formed by one power path and one ground path. Therefore, it only supports the charging current less than 3 A, so that the charging speed is slow and time is wasted. In addition, the inserting tongue of the power line and the inserting tongue of the ground line of the USB interface in the related art are made of metal foil with conductivity less than 20%, which cannot support the large current (greater than 3 A) charging. Therefore, the USB interface in the related art has the small charging current and the low charging speed based on limitations of the single charging circuit and the material thereof.

DISCLOSURE

Technical Problem

An objective of the present disclosure is to provide a USB interface having an inserting tongue of a power line with at least two inserting portions and an inserting tongue of a ground line with at least two inserting portions, so as to solve problems of slow charging speed when a standard MICRO USB interface is used for charging in the mobile terminal in the related art.

Solution to Problem

Technical Solution

In one aspect, a USB interface includes: a USB interface main body, an inserting tongue of a power line configured for coupling to an external power line via inserting portions and an inserting tongue of a ground line configured for coupling to an external ground line via inserting portions. A bottom of the inserting tongue of the power line and a bottom edge of the inserting tongue of the ground line are coupled to the USB interface main body.

The inserting tongue of the power line has P inserting portions extending therefrom, where P is greater than or equal to 2.

The inserting tongue of the ground line has Q inserting portions extending therefrom, where Q is greater than or equal to 2.

In another aspect, a mobile terminal includes the above USB interface.

TECHNICAL EFFECTS OF THE PRESENT DISCLOSURE

Technical Effects

The present disclosure has the following benefits. The MICRO USB interface (socket) in the related art is improved to obtain the USB interface in the present disclosure, which has the inserting tongue of the power line with at least two inserting portions and the inserting tongue of the ground line with at least two inserting portions. Therefore, the plurality of inserting portions in the inserting tongue of the power line is capable of receiving signals simultaneously and the plurality of power pins shares the current when this USB interface is used for charging, so that at least two charging circuits are formed by the inserting tongue of the power line and the inserting tongue of the ground line, which are capable of supporting the charging with large current greater than 3 A and also realize that one mobile terminal transmits the large current to another mobile terminal for driving the other mobile terminal to work. In addition, both the inserting tongue of the power line and the inserting tongue of the ground line included in the USB interface provided in embodiments of the present disclosure are made of phosphor bronze with conductivity reaching 50%, and therefore compared to the MICRO USB interface with lower conductivity in the related art, the USB interface of the present disclosure may support the charging with larger current. The USB interface in the present disclosure is capable of fast charging based on the above two charging circuits and usage of the material with high conductivity.

BRIEF DESCRIPTION OF THE DRAWINGS

Drawings Description

In order to make the technical solutions of embodiments of the present disclosure more clearly, the accompanying drawings used in the description of embodiments of the present disclosure are briefly described hereunder. Obviously, the described drawings are merely some embodiments of present disclosure. For persons skilled in the art, other drawings may be obtained based on these drawings without any creative work.

EMBODIMENTS OF THE PRESENT DISCLOSURE

Implementations of the Present Disclosure

To make the objectives, the technical solutions, and the advantages of embodiments of the present disclosure clearer, the technical solutions in embodiments of the present disclosure are hereinafter described clearly and completely with reference to the accompanying drawings in embodiments of the present disclosure. It should be understood that, specific embodiments described herein are merely used to explain the present disclosure, but not used to limit the present disclosure. In order to illustrate the technical solutions of the present disclosure, specific embodiments are described in the following.

It should be noted that, a charging adapter in embodiments of the present disclosure includes: a power adapter, a charger, a terminal (for example, an IPAD, a smart phone) capable of outputting power signals to charge a cell (the cell of the mobile terminal), or the like.

It should be noted that, the USB interface provided in the embodiments of the present disclosure is a socket. The USB interface is arranged on the mobile terminal and is configured for data transmission and charging. In order to realize the large current charging, the USB interface may support a USB plug including an inserting tongue of a power line having at least two inserting portions and an inserting tongue of a ground line having at least two inserting portions. Further, the inserting tongue of the power line and the inserting tongue of the ground line provided in the embodiments of the present disclosure may be used in connection with the USB plug to form at least two charging circuits, thus realizing the charging with large current greater than 3 A. Meanwhile, the USB interface may also be used in cooperation with the USB MICRO plug in the related art.

Figure 1:
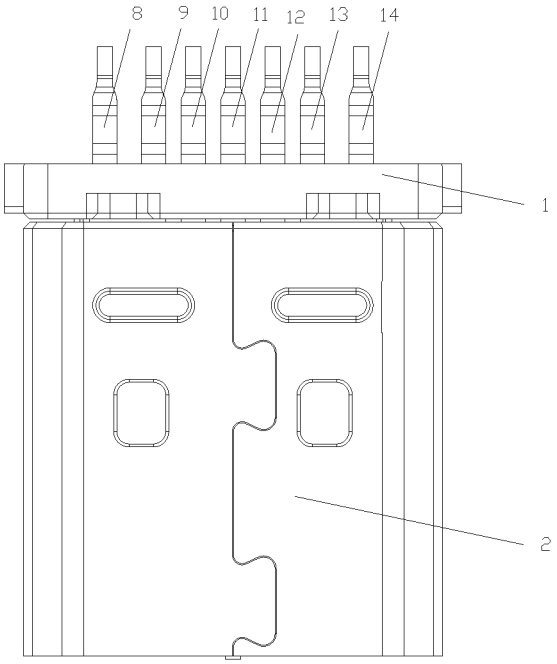
FIG. 1 is a schematic diagram showing a structure of a USB interface provided in embodiments of the present disclosure.
Figure 2:
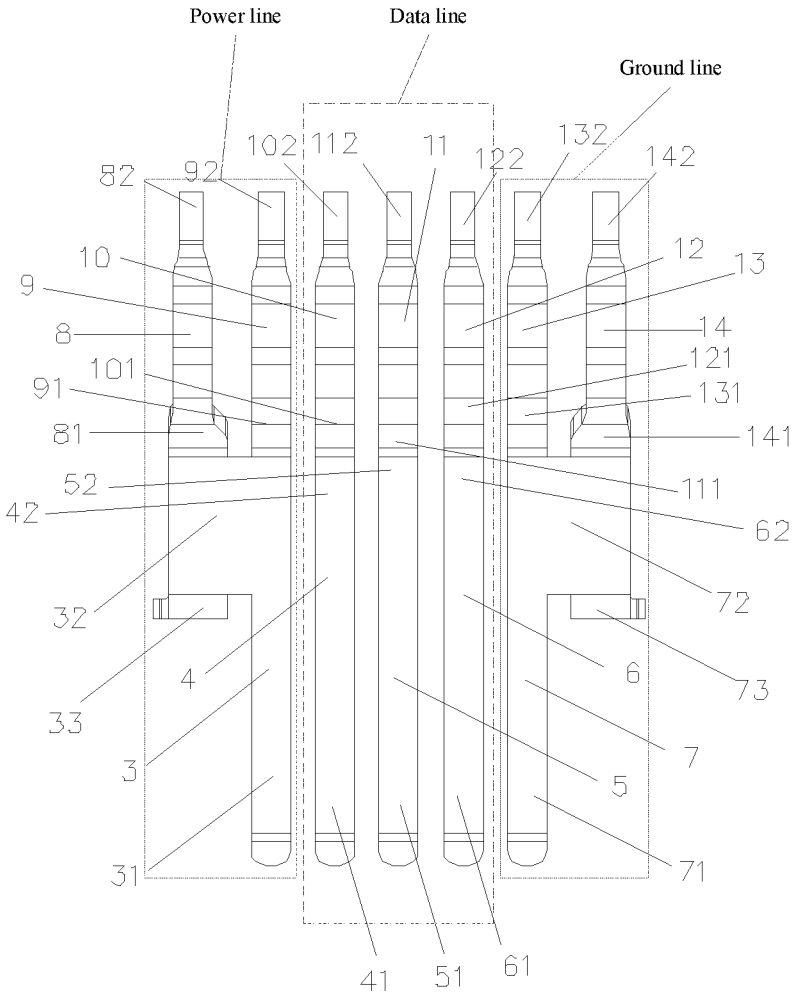
FIG. 2 is a schematic diagram showing an internal structure of a USB interface provided in embodiments of the present disclosure.

Description is made in combination with FIG. 1 that shows a structure of a USB interface provided in embodiments of the present disclosure and FIG. 2 that shows an internal structure of a USB interface (not including a USB interface main body 1 and an inserting housing 2). It should be noted that, FIGS. 1 and 2 are only illustration of the USB interface provided in the embodiments of the present disclosure, thereby only giving structure diagrams showing an inserting tongue of a power line having two inserting portions, an inserting tongue of a ground line having two inserting portions, two power pins and two ground pins.

The USB interface provided in the embodiments of the present disclosure includes: a USB interface main body 1, an inserting tongue 3 of a power line configured for coupling to an external power line via inserting portions 31, 33, and an inserting tongue 7 of a ground line configured for coupling to an external ground line via inserting portions 71, 73. A bottom 32 of the inserting tongue 3 of the power line and a bottom edge 72 of the inserting tongue 7 of the ground line are coupled to the USB interface main body 1.

The inserting tongue of the power line has P inserting portions extending therefrom, and P is greater than or equal to 2.

The inserting tongue of the ground line has Q inserting portions extending therefrom, and Q is greater than or equal to 2.

In addition, taking the USB interface provided in FIGS. 1 and 2 as an example, the inserting portion 31 and the inserting portion 33 of the inserting tongue 3 of the power line are coupled to two corresponding power lines in the USB plug to receive large-current power signals output by the charging adapter through the USB plug, during the large-current charging (for example, the charging current greater than 3 A). Meanwhile, the inserting portion 71 and the inserting portion 73 of the inserting tongue 7 of the ground line are coupled to two corresponding ground lines in the USB plug to form a large-current charging circuit.

In addition, taking the USB interface provided in FIGS. 1 and 2 as an example, in order to add one inserting portion to the inserting tongue of the power line provided in the USB interface in the related art, a current flowing area at a bottom of the inserting tongue of the power line is increased in the embodiments of the present disclosure during design and manufacture; meanwhile, a current flowing area at a bottom of the inserting tongue of the ground line is also increased, so as to add one inserting portion to the inserting tongue of the ground line provided in the USB interface in the related art. Further, compared to the MICRO USB interface in the related art, the inserting tongue 3 of the power line and the inserting tongue 7 of the ground line with the increased current flowing area may effectively improve a maximum allowable charging current, which is at least twice as large as the charging current supported by the MICRO USB interface in the related art, thereby satisfying requirements of the large-current charging.

Therefore, it should be inferred reasonably that, based on requirements of the charging current needed for charging the cell of the mobile terminal, the current flowing areas may be increased by increasing areas of bottoms of the inserting tongue of the power line and the inserting tongue of the ground line, and meanwhile, one or more inserting portions may be added to the inserting tongue of the power line, and one or more inserting portions may be added to the inserting tongue of the ground line, so as to improve the charging current received from the USB plug. Certainly, the USB plug in the charging adapter may be designed accordingly (the current flowing areas may be increased by increasing areas of bottoms of the power line inserting tongue and the ground line inserting tongue, one or more inserting portions may be added to the inserting tongue of the power line and one or more inserting portions may be added to the inserting tongue of the ground line). Further, the inserting portions of the inserting tongue of the power line and the inserting portions of the inserting tongue of the ground line may be increased based on requirements, thereby improving the charging current for charging the cell of the mobile terminal by using the charging adapter.

In at least one embodiment, both the inserting tongue of the power line and the inserting tongue of the ground line are made of phosphor bronze. It should be noted that, in the related art, the inserting tongue of the power line and the inserting tongue of the ground line in the MICRO USB interface used for charging the cell of the mobile terminal are made of metal foil with conductivity less than 20%. However, the inserting tongue of the power line and the inserting tongue of the ground line included in the USB interface provided in the embodiments of the present disclosure are made of phosphor bronze with conductivity reaching 50%. Therefore, compared to the MICRO USB interface in the related art, the USB interface provided in the embodiments of the present disclosure can withstand the larger charging current. In at least one embodiment, both the inserting tongue of the power line and the inserting tongue of the ground line are made of phosphor bronze C7025.

In at least one embodiment, both the inserting tongue of the power line and the inserting tongue of the ground line are made of chromium bronze. All of the inserting tongue of the power line and the inserting tongue of the ground line included in the USB interface provided in the embodiments of the present disclosure are made of chromium bronze with conductivity reaching 70%, and thus compared to the MICRO USB interface in the related art, the USB interface provided in the embodiments of the present disclosure can withstand the larger charging current. In at least one embodiment, both the inserting tongue of the power line and the inserting tongue of the ground line are made of chromium bronze C18400.

In another embodiment of the present disclosure, the USB interface further includes a power pin configured for charging the cell in the mobile terminal through a terminal and a ground pin configured for forming a charging circuit for charging the cell.

There are M power pins, where M is greater than or equal to 2, and each power pin is coupled to the bottom of the inserting tongue of the power line. There are N ground pins, where N is greater than or equal to 2, and each ground pin is coupled to the bottom of the inserting tongue of the ground line.

Taking the USB interface provided in FIGS. 1 and 2 as an example, two power pins (a power pin 8 and a power pin 9) are coupled to a bottom 32 of the inserting tongue 3 of the power line, so that the power signals received from the inserting tongue of the power line may be divided into two routes for transmission through the power pin 8 and the power pin 9, so as to charge the cell of the mobile terminal. Meanwhile, since two ground pins (a ground pin 13 and a ground pin 14) are coupled to a bottom 72 of the inserting tongue 7 of the ground line, the negative electrode of the cell forms an electrical path with the two ground pins via a circuit, and further works together with the two power pins (the power pin 8 and the power pin 9), the inserting tongue 3 of the power line and the inserting tongue 7 of the ground line as a portion circuit of the charging circuit for charging the cell.

In conclusion, the number of the power pins and the number of the ground pins may be increased based on the charging current needed for charging the cell of the mobile terminal, such that at least two charging circuits for charging the cell may be formed, thereby effectively reducing power consumption, reducing heat, and avoiding burning of the charging circuit.

In at least one embodiment, each power pin and each ground pin are made of phosphor bronze. It should be noted that, in the related art, all the power pin and the ground pin in the MICRO USB interface for charging the cell of the mobile terminal are made of metal foil with conductivity less than 20%. However, all the power pins and the ground pins included in the USB interface provided in the embodiments of the present disclosure are made of phosphor bronze with conductivity reaching 50%. Therefore, compared to the MICRO USB interface in the related art, the USB interface provided in the embodiments of the present disclosure can withstand the larger charging current. In at least one embodiment, each power pin and each ground pin both are made of phosphor bronze C7025.

In at least one embodiment, each power pin and each ground pin are made of chromium bronze. All the power pins and the ground pins included in the USB interface provided in the embodiments of the present disclosure are made of chromium bronze with conductivity reaching 70%. Therefore, compared to the MICRO USB interface in the related art, the USB interface provided in the embodiments of the present disclosure can withstand the larger charging current. In at least one embodiment, each power pin and each ground pin are made of chromium bronze C18400.

As an embodiment of the present disclosure, the USB interface further includes a positive inserting tongue 5 of a data line, an inserting tongue 6 of the data line, a negative inserting tongue 4 of the data line, a positive data pin 11, a data pin 12, and a negative data pin 10.

Each of a bottom of the positive inserting tongue of a data line, the inserting tongue of the data line, and the negative inserting tongue of the data line is fixed to the USB interface main body, the bottom 52 of the positive inserting tongue 5 of the data line is coupled to a bottom 111 of the positive data pin 11, the bottom 62 of the inserting tongue 6 of the data line is coupled to a bottom 121 of the data pin 12, and the bottom 42 of the negative inserting tongue 4 of the data line is coupled to a bottom 101 of the negative data pin 10.

Taking the USB interface provided in FIGS. 1 and 2 as an example, the USB interface provided in the embodiments of the present disclosure may be used for the large-current charging and may also be used for data communication between two mobile terminals. In particular, when one mobile terminal uses the USB interface for data communication, the inserting tongue 3 of the power line having at least two inserting portions, the inserting tongue 7 of the ground line having at least two inserting portions, at least two power pins and at least two ground pins are used to transmit the large-current power signals for driving another mobile terminal to work.

In another embodiment of the present disclosure, differential data transmission may be realized by the positive inserting tongue 5 of the data line, the negative inserting tongue 4 of the data line, the positive data pin 11 and the negative data pin 10. If the mobile terminal uses the OTG technology for data transmission, the data transmission may be realized by the inserting tongue 6 of the data line and the data pin 12.

Further, the USB interface provided in the embodiment may be used to cooperate with the USB plug including the inserting tongue of the power line having at least two inserting portions and the inserting tongue of the ground line having at least two inserting portions, for data transmission and the large-current charging.

In another embodiment of the present disclosure, the USB interface further includes an insertion housing, and each of the inserting portions of the inserting tongue of the power line, the inserting portions of the inserting tongue of the ground line, an inserting portion of the positive inserting tongue of the data line, an inserting portion of the inserting tongue of the data line and an inserting portion of the negative inserting tongue of the data line are inserted and fixed into the insertion housing. Being inserted and fixed into the insertion housing means that each of the inserting portions of the inserting tongue of the power line, the inserting portions of the inserting tongue of the ground line, the inserting portion of the positive inserting tongue of the data line, the inserting portion of the inserting tongue of the data line and the inserting portion of the negative inserting tongue of the data line is inserted into the insertion housing and fixed to the insertion housing.

Taking the USB interface provided in FIGS. 1 and 2 as an example, the USB plug may be better insertion-coupled to the USB interface provided in the embodiment by the insertion housing 2, such that the inserting portions of the inserting tongues (the inserting portion 31 and the inserting portion 33 of the inserting tongue 3 of the power line, the inserting portion 71 and the inserting portion 73 of the inserting tongue 7 of the ground line, the inserting portion 51 of the positive inserting tongue 5 of the data line, the inserting portion 61 of the inserting tongue 6 of the data line and the inserting portion 41 of the negative inserting tongue 4 of the data line) may be in good contact with corresponding inserting tongues in the USB plug for realizing good transmission of signals.

In another embodiment of the present disclosure, the P inserting portions included in the inserting tongue of the power line, an inserting portion of the negative inserting tongue of the data line, an inserting portion of the positive inserting tongue of the data line, an inserting portion of the inserting tongue of the data line and the Q inserting portions included in the inserting tongue of the ground line are arranged in sequence at equal spacing.

Taking the USB interface provided in FIGS. 1 and 2 as an example, if the arrangement order of the inserting portion 31 and the inserting portion 33 of the inserting tongue 3 of the power line, the inserting portion 71 and the inserting portion 73 of the inserting tongue 7 of the ground line, the inserting portion 51 of the positive inserting tongue 5 of the data line, the inserting portion 61 of the inserting tongue 6 of the data line and the inserting portion 41 of the negative inserting tongue 4 of the data line is not limited, the inserting portions arranged at equal spacing facilitate standardized production and usage. In at least one embodiment, the spacing between each two adjacent inserting portions may be equal to the spacing between inserting portions corresponding to two adjacent inserting tongues in the MICRO USB interface in the related art. Thus, when the MICRO USB interface in the related art is coupled to the USB interface provided in the embodiments, it is possible to ensure that the inserting portion 31 of the inserting tongue 3 of the power line is well coupled to the power line in the MICRO USB interface; accordingly, it is also possible to ensure that the inserting portion 71 of the inserting tongue 7 of the ground line is well coupled to the ground line in the MICRO USB interface, and the inserting portion 51 of the positive inserting tongue 5 of the data line, the inserting portion 61 of the inserting tongue 6 of the data line and the inserting portion 41 of the negative inserting tongue 4 of the data line are well coupled to the positive data line, the data line and the negative data line in the MICRO USB interface respectively.

In another embodiment of the present disclosure, the P inserting portions included in the inserting tongue of the power line, an inserting portion of the negative inserting tongue of the data line, an inserting portion of the positive inserting tongue of the data line, an inserting portion of the inserting tongue of the data line and the Q inserting portions included in the inserting tongue of the ground line are arranged in sequence at equal spacing. Being arranged in sequence at equal spacing means that the P inserting portions included in the inserting tongue of the power line, the inserting portion of the negative inserting tongue of the data line, the inserting portion of the positive inserting tongue of the data line, the inserting portion of the inserting tongue of the data line and the Q inserting portions included in the inserting tongue of the ground line are arranged according to a certain sequence and spacing between two adjacent inserting portions are identical.

Taking the USB interface provided in FIGS. 1 and 2 as an example, in order to realize compatibility with the MICRO USB interface in the related art, the insertion tongues are embedded and fixed into the USB interface main body 1 at equal spacing according to an order of the inserting tongue 3 of the power line, the negative inserting tongue 4 of the data line, the positive inserting tongue 5 of the data line, the inserting tongue 6 of the data line and the inserting tongue 7 of the ground line in the embodiments of the present disclosure, since lines are arranged according to an order of the power line, the negative data line, the positive data line, the data line and the ground line in the MICRO USB interface in the related art. Meanwhile, the inserting portion 33 of the inserting tongue 3 of the power line, the inserting portion 31 of the inserting tongue 3 of the power line, the inserting portion 41 of the negative inserting tongue 4 of the data line, the inserting portion 51 of the positive inserting tongue 5 of the data line, the inserting portion 61 of the inserting tongue 6 of the data line, the inserting portion 71 of the inserting tongue 7 of the ground line and the inserting portion 72 of the inserting tongue 7 of ground line are arranged in the fixed sequence. Thus, when the MICRO USB interface is coupled to the USB interface provided in the embodiment, the power line, the negative data line, the positive data line, the data line and the ground line in the MICRO USB interface are coupled to the inserting tongue 3 of the power line, the negative inserting tongue 4 of the data line, the positive inserting tongue 5 of the data line, the inserting tongue 6 of the data line and the inserting tongue 7 of the ground line in the USB interface respectively, thereby realizing good compatibility with the MICRO USB interface in the related art.

In another embodiment of the present disclosure, a first inserting portion of the inserting tongue of the power line adjacent to the inserting portion of the negative inserting tongue of the data line is longer than any other inserting portions in the inserting tongue of the power line.

In another embodiment of the present disclosure, a first inserting portion of the inserting tongue of the ground line adjacent to the inserting portion of the inserting tongue of the data line is longer than any other inserting portions in the inserting tongue of the ground line.

Taking the USB interface provided in FIGS. 1 and 2 as an example, in order to realize compatibility with the MICRO USB plug in the related art, the inserting portion 33 in the inserting tongue 3 of the power line is designed to be a little shorter and the inserting portion 73 in the inserting tongue 7 of the ground line is designed to be a little shorter, so that when the MICRO USB plug in the related art is used for connection, only the inserting portion 51 of the positive inserting tongue 5 of the data line, the inserting portion 61 of the inserting tongue 6 of the data line, the inserting portion 41 of the negative inserting tongue 4 of the data line, the inserting portion 31 of the inserting tongue 3 of the power line and the inserting portion 71 of the inserting tongue 7 of the ground line in the USB interface provided in FIG. 1 and FIG. 2 are coupled to corresponding inserting tongues in the MICRO USB plug for data communication or charging. The inserting portion 33 of the inserting tongue 3 of the power line and the inserting portion 73 of the inserting tongue 7 of the ground line are suspended (i.e., are not coupled to the power line and the ground line in the MICRO USB plug).

In at least one embodiment, the longer inserting portion of the inserting tongue of the power line, the longer inserting portion of the inserting tongue of the ground line, the inserting portion of the positive inserting tongue of the data line, the inserting portion of the inserting tongue of the data line and the inserting portion of the negative inserting tongue of the data line extend equal lengths in an insertion-connection direction.

Taking the USB interface provided in FIGS. 1 and 2 as an example, in order to realize compatibility with the MICRO USB interface in the related art and to provide good electrical contact, the longer inserting portion 71 in the inserting tongue 7 of the ground line, the longer inserting portion 31 in the inserting tongue 3 of the power line, the inserting portion 51 of the positive inserting tongue 5 of the data line, the inserting portion 61 of the inserting tongue 6 of the data line and the inserting portion 41 of the negative inserting tongue 4 of the data line have the same length. In at least one embodiment, the above length is equal to a length of the inserting portions of the inserting tongues in the MICRO USB interface in the related art. Thus, if the longer inserting portion 71 in the inserting tongue 7 of the ground line, the longer inserting portion 31 in the inserting tongue 3 of the power line, the inserting portion 51 of the positive inserting tongue 5 of the data line, the inserting portion 61 of the inserting tongue 6 of the data line and the inserting portion 41 of the negative inserting tongue 4 of the data line are designed to be longer and to have the same length, it may ensure that the above inserting portions may be coupled to the MICRO USB interface in the related art well, thereby realizing good data communication, as well as good transmission of power signals and ground signals.

In another embodiment of the present disclosure, all shorter inserting portions of the inserting tongue of the power line and all shorter inserting portions of the inserting tongue of the ground line extend equal lengths in the insertion-connection direction.

Taking the USB interface provided in FIGS. 1 and 2 as an example, the shorter inserting portion 33 in the inserting tongue 3 of the power line and the shorter inserting portion 73 in the inserting tongue 7 of the ground line extend equal lengths in the insertion-connection direction. Specifically, the shorter inserting portion 33 in the inserting tongue 3 of the power line and the shorter inserting portion 73 in the inserting tongue 7 of the ground line are designed to extend outward a shorter length, so that when the USB interface is coupled to the MICRO USB interface in the related art, the shorter inserting portion 33 in the inserting tongue 3 of the power line and the shorter inserting portion 73 in the inserting tongue 7 of the ground line are not coupled to the insertion-connection pins and are in the empty state, thereby realizing compatibility with the standard MICRO USB interface in the related art.

In another embodiment of the present disclosure, terminals of the M power pins, a terminal of the negative data pin, a terminal of the positive data pin, a terminal of the data pin and terminals of the N ground pins are arranged in sequence at equal spacing.

Taking the USB interface provided in FIGS. 1 and 2 as an example, after the arrangement order of the inserting portion 31 and the inserting portion 33 of the inserting tongue 3 of the power line, the inserting portion 71 and the inserting portion 73 of the inserting tongue 7 of the ground line, the inserting portion 51 of the positive inserting tongue 5 of the data line, the inserting portion 61 of the inserting tongue 6 of the data line and the inserting portion 41 of the negative inserting tongue 4 of the data line are fixed, the arrangement order of terminals of the two power pins (a terminal 82 of the power pin 8 and a terminal 92 of the power pin 9), a terminal 102 of the negative data pin 10, a terminal 112 of the positive data pin 11, a terminal 122 of the data pin 12 and terminals of the two ground pins (a terminal 132 of the ground pin 13 and a terminal 142 of the ground pin 14) are fixed accordingly. Similarly, the terminals of the pins arranged at equal spacing facilitate standardized production and usage. In at least one embodiment, the spacing between terminals of each two adjacent pins is equal to the spacing between terminals of each two adjacent pins in the MICRO USB interface in the related art.

In at least one embodiment, the terminals of the M power pins, the terminal of the negative data pin, the terminal of the positive data pin, the terminal of the data pin and the terminals of the N ground pins are arranged in sequence at equal spacing.

Taking the USB interface provided in FIGS. 1 and 2 as an example, in order to realize compatibility with the MICRO USB interface in the related art, after the arrangement order of the inserting tongues is determined, the arrangement order of the pins is determined accordingly, which is as follows: the terminal 82 of the power pin 8, the terminal 92 of the power pin 9, the terminal 102 of the negative data pin 10, the terminal 112 of the positive data pin 11, the terminal 122 of the data pin 12, the terminal 132 of the ground pin 13 and the terminal 142 of the ground pin 14.

In another embodiment of the present disclosure, for the power pin(s) (added for the USB interface provided in embodiments of the present disclosure based on the MICRO USB interface in the related art) and the ground pin(s) (added for the USB interface of the embodiments of the present disclosure based the MICRO USB interface in the related art) located at edges, the spacing between each two power pins and the spacing between each two ground pins are designed according to actual requirements. That is, the designed spacing between each two power pins may be not equal to the spacing between pins arranged at equal spacing and the designed spacing between each two ground pins may be not equal to the spacing between pins arranged at equal spacing. In this way, the spacing between the power pins and the spacing between the ground pins may be changed on the basis of compatibility with the MICRO USB interface in the related art.

In another embodiment of the present disclosure, a bottom width of a terminal of a first power pin adjacent to the negative data pin is smaller than that of any other power pins; a bottom width of a terminal of a first ground pin adjacent to the data pin is smaller than that of any other ground pins.

Taking the USB interface provided in FIGS. 1 and 2 as an example, a bottom width of the power pin 8 (i.e., width of bottom 81 of the power pin 8) is larger than a bottom width of the power pin 9 (i.e., width of bottom 91 of the power pin 9); a bottom width of the ground pin 14 (i.e., width of bottom 141 of the ground pin 14) is larger than a bottom width of the ground pin 13 (i.e., width of bottom 131 of the ground pin 13). Specifically, compared to the power pin provided in the MICRO USB interface in the related art, the power pin 8 with the wider bottom width is newly added and is used for sharing the large current when charging with the large current. Since the power pin 8 with the wider bottom width is mainly used for charging with the large current, the bottom width of the power pin 8 is designed to be wider than that of the power pin 9 in the related art, thereby sharing most of the charging current and withstanding the large current.

Similarly, compared to the ground pin provided in the MICRO USB interface in the related art, the ground pin 14 with the wider bottom width is newly added. The bottom width of the ground pin 14 is designed to be wider than that of the ground pin 13 in the related art, thereby sharing most of the charging current and withstanding the large-current.

The USB interface provided in the embodiment of the present disclosure is improvement on the basis of the MICRO USB interface in the related art and has at least two power pins, at least two ground pins, the inserting tongue of the power line having at least two inserting portions and the inserting tongue of the ground line having at least two inserting portions, which increases a conductive area for flowing through the large current, thereby at least supporting the charging current equal to or greater than 3 A. If the conductive areas at the bottom of the inserting tongue of the power line and at the bottom of the inserting tongue of the ground line are further increased, the number of the inserting portions in the inserting tongue of the power line is further increased and the number of the inserting portions in the inserting tongue of the ground line is further increased, the larger charging current may be supported. In at least one embodiment, if the material with better conductivity (such as phosphor bronze C7025 or chrome bronze C18400) is selected, the conductive areas at the bottom of the inserting tongue of the power line and at the bottom of the inserting tongue of the ground line may be reduced correspondingly or the USB interface supporting the larger charging current may be provided.

In at least one embodiment, in the USB interface provided in the embodiments of the present disclosure, the pins (including: each power pin, the negative data pin, the positive data pin, the data pin and each ground pin) and the inserting tongues (including: the inserting tongue of the power line, the negative inserting tongue of the data line, the positive inserting tongue of the data line, the inserting tongue of the data line and the inserting tongue of ground line) are the I-shaped. Thus, since the pins and the inserting tongues included in the USB interface provided in the embodiment of the present disclosure are I-shaped, it may satisfy the design standards of pins and inserting tongues in the related art and realize good compatibility with the MICRO USB interface in the related art.

The embodiments of the present disclosure also provide a mobile terminal including the above USB interface.

With the USB interface, the large current may be provided for driving other mobile terminals, such that communicate with other mobile terminals may be performed. In addition, the charging adapter may also charge the cell of the mobile terminal through the USB interface.

The foregoing description is further explanation for the present disclosure with reference to preferred embodiments, and cannot be used to limit the present disclosure. For those ordinary skilled in the art, equivalents, alternatives and obvious variants may be made without departing from the spirit of the present disclosure, may have same functions or usages, and may belong to the protection scope determined by the claims submitted in the present disclosure.

What is claimed is:

1. A USB (Universal Series Bus) interface, comprising:

a USB interface main body, an inserting tongue of a power line configured for coupling to an external power line via inserting portions and an inserting tongue of a ground line configured for coupling to an external ground line via inserting portions; wherein, a bottom of the inserting tongue of the power line and a bottom edge of the inserting tongue of the ground line are coupled to the USB interface main body, the inserting tongue of the power line has P inserting portions extending therefrom, where P is greater than or equal to 2; and the inserting tongue of the ground line has Q inserting portions extending therefrom, where Q is greater than or equal to 2;

wherein, the USB interface further comprises a power pin configured for charging a cell in a mobile terminal through a terminal and a ground pin configured for forming a charging circuit for charging the cell;

there are M power pins, where M is greater than or equal to 2, and each power pin is coupled to the bottom of the inserting tongue of the power line;

there are N ground pins, where N is greater than or equal to 2, and each ground pin is coupled to the bottom of the inserting tongue of the ground line.

2. The USB interface according to claim 1, wherein, the USB interface further comprises a positive inserting tongue of a data line, an inserting tongue of the data line, a negative inserting tongue of the data line, a positive data pin, a data pin and a negative data pin;

each of a bottom of the positive inserting tongue of the data line, the inserting tongue of the data line, and the negative inserting tongue of the data line is fixed to the USB interface main body, the bottom of the positive inserting tongue of the data line is coupled to a bottom of the positive data pin, the bottom of the inserting tongue of the data line is coupled to a bottom of the data pin, and the bottom of the negative inserting tongue of the data line is coupled to a bottom of the negative data pin.

3. The USB interface according to claim 2, wherein, the USB interface further comprises an insertion housing;

each of the inserting portions of the inserting tongue of the power line, the inserting portions of the inserting tongue of the ground line, an inserting portion of the positive inserting tongue of the data line, an inserting portion of the inserting tongue of the data line and an inserting portion of the negative inserting tongue of the data line are inserted and fixed into the insertion housing.

4. The USB interface according to claim 2, wherein, the P inserting portions of the inserting tongue of the power line, an inserting portion of the negative inserting tongue of the data line, an inserting portion of the positive inserting tongue of the data line, an inserting portion of the inserting tongue of the data line and the Q inserting portions of the inserting tongue of the ground line are arranged in sequence at equal spacing.

5. The USB interface according to claim 4, wherein, a first inserting portion of the inserting tongue of the power line adjacent to the inserting portion of the negative inserting tongue of the data line is longer than any other inserting portions in the inserting tongue of the power line;

a first inserting portion of the inserting tongue of the ground line adjacent to the inserting portion of the inserting tongue of the data line is longer than any other inserting portions in the inserting tongue of the ground line.

6. The USB interface according to claim 2, wherein, terminals of the M power pins, a terminal of the negative data pin, a terminal of the positive data pin, a terminal of the data pin and terminals of the N ground pins are arranged in sequence at equal spacing.

7. The USB interface according to claim 6, wherein, a bottom width of a terminal of a first power pin adjacent to the negative data pin is smaller than that of any other power pins;

a bottom width of a terminal of a first ground pin adjacent to the data pin is smaller than that of any other ground pins.

8. The USB interface according to claim 1, wherein, the inserting tongue of the power line is made of phosphor bronze or chromium bronze, and the inserting tongue of the ground line is made of phosphor bronze or chromium bronze; each power pin is made of phosphor bronze or chromium bronze, and each ground pin is made of phosphor bronze or chromium bronze; and P is equal to Q and M is equal to N.

9. A mobile terminal, comprising a USB interface, wherein the USB interface comprises a USB interface main body, an inserting tongue of a power line configured for coupling to an external power line via inserting portions and an inserting tongue of a ground line configured for coupling to an external ground line via inserting portions; a bottom of the inserting tongue of the power line and a bottom edge of the inserting tongue of the ground line are coupled to the USB interface main body; the inserting tongue of the power line has P inserting portions extending therefrom, where P is greater than or equal to 2; and the inserting tongue of the ground line has Q inserting portions extending therefrom, where Q is greater than or equal to 2;

wherein, the USB interface further comprises a power pin configured for charging a cell in a mobile terminal through a terminal and a ground pin configured for forming a charging circuit for charging the cell;

there are M power pins, where M is greater than or equal to 2, and each power pin is coupled to the bottom of the inserting tongue of the power line;

there are N ground pins, where N is greater than or equal to 2, and each ground pin is coupled to the bottom of the inserting tongue of the ground line.

10. The USB interface according to claim 4, wherein, the spacing between adjacent inserting portions of the USB interface is equal to that between adjacent inserting portions in a conventional MICRO USB interface.

11. The USB interface according to claim 5, wherein, the first inserting portion of the inserting tongue of the power line, the first inserting portion of the inserting tongue of the ground line, the inserting portion of the positive inserting tongue of the data line, the inserting portion of the inserting tongue of the data line and the inserting portion of the negative inserting tongue of the data line extend an equal length in the insertion-connection direction.

12. The USB interface according to claim 5, wherein, the other inserting portions of the inserting tongue of the power line and the other inserting portions of the inserting tongue of the ground line extend an equal length in the insertion-connection direction.

13. The USB interface according to claim 2, wherein, each power pin, the negative data pin, the positive data pin, the data pin, each ground pin, the inserting tongue of the power line, the negative inserting tongue of the data line, the positive inserting tongue of the data line, the inserting tongue of the data line and the inserting tongue of the ground line are I-shaped.

14. The USB interface according to claim 4, wherein, the P inserting portions of the inserting tongue of the power line, the inserting portion of the negative inserting tongue of the data line, the inserting portion of the positive inserting tongue of the data line, the inserting portion of the inserting tongue of the data line and the Q inserting portions of the inserting tongue of the ground line are arranged according to an arrangement sequence of a power line, a negative data line, a positive data line, a data line and a ground line in a conventional MICRO USB interface.

15. The USB interface according to claim 6, wherein, terminals of the M power pins, a terminal of the negative data pin, a terminal of the positive data pin, a terminal of the data pin and terminals of the N ground pins are arranged according to the arrangement sequence of the P inserting portions of the inserting tongue of the power line, the inserting portion of the negative inserting tongue of the data line, the inserting portion of the positive inserting tongue of the data line, the inserting portion of the inserting tongue of the data line and the Q inserting portions of the inserting tongue of the ground line.

16. A USB interface, comprising:

a USB interface main body;

an inserting tongue of a power line configured for coupling to an external power line via at least two inserting portions;

an inserting tongue of a ground line configured for coupling to an external ground line via at least two inserting portions;

at least two power pins configured for charging a cell in a mobile terminal;

and at least two ground pins configured for forming at east charging circuits for charging the cell, wherein, a bottom of the inserting tongue of the power line and a bottom of the inserting tongue of the ground line are coupled to the at least two power pins and the at least two ground pins, respectively.

17. The USB interface according to claim 16, further comprising a positive inserting tongue of a data line, an inserting tongue of the data line, a negative inserting tongue of the data line, a positive data pin, a data pin and a negative data pin, wherein each of a bottom of the positive inserting tongue of the data line, the inserting tongue of the data line, and the negative inserting tongue of the data line is fixed to the USB interface main body, the bottom of the positive inserting tongue of the data line is coupled to a bottom of the positive data pin, the bottom of the inserting tongue of the data line is coupled to a bottom of the data pin, and the bottom of the negative inserting tongue of the data line is coupled to a bottom of the negative data pin.

18. The USB interface according to claim 17, further comprising an insertion housing, wherein each of the inserting portions of the inserting tongue of the power line, the inserting portions of the inserting tongue of the ground line, an inserting portion of the positive inserting tongue of the data line, an inserting portion of the inserting tongue of the data line and an inserting portion of the negative inserting tongue of the data line are inserted and fixed into the insertion housing.

19. The USB interface according to claim 17, wherein the at least two inserting portions of the inserting tongue of the power line, an inserting portion of the negative inserting tongue of the data line, an inserting portion of the positive inserting tongue of the data line, an inserting portion of the inserting tongue of the data line and the at least two inserting portions of the inserting tongue of the ground line are arranged in sequence at equal spacing.

* * * * *